US006374916B1

(12) United States Patent
Laflin

(10) Patent No.: US 6,374,916 B1
(45) Date of Patent: Apr. 23, 2002

(54) METHOD AND APPARATUS FOR STIFFENING AN OUTPUT SHAFT ON A CUTTING TOOL ASSEMBLY

(75) Inventor: Walter J. Laflin, Houston, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 09/426,031

(22) Filed: Oct. 25, 1999

(51) Int. Cl.[7] ..... E21B 10/00; E21B 29/06

(52) U.S. Cl. ..... 166/298; 166/55; 175/320; 175/327

(58) Field of Search ..... 175/320, 327, 175/414, 415; 166/298, 55, 55.6

(56) References Cited

U.S. PATENT DOCUMENTS

| | | | | | |
|---|---|---|---|---|---|
| 1,079,836 | A | * | 11/1913 | Canfield | 175/320 |
| 4,043,409 | A | * | 8/1977 | Walter | 175/321 |
| 5,222,554 | A | | 6/1993 | Blount et al. | 166/117.6 |
| 5,429,187 | A | | 7/1995 | Beagrie et al. | 166/55.1 |
| 5,551,509 | A | | 9/1996 | Braddick | 166/55.7 |
| 5,595,254 | A | * | 1/1997 | Tibbitts | 175/320 |
| 5,620,051 | A | | 4/1997 | Carter et al. | 166/298 |
| 5,647,436 | A | | 7/1997 | Braddick | 166/298 |
| 5,709,265 | A | | 1/1998 | Haugen et al. | 166/55.2 |
| 5,769,166 | A | | 6/1998 | Duke | 166/298 |
| 5,769,167 | A | | 6/1998 | Braddick | 166/382 |
| 5,787,978 | A | | 8/1998 | Carter et al. | 166/117.6 |
| 5,803,192 | A | * | 9/1998 | Holte | 175/296 |

FOREIGN PATENT DOCUMENTS

| | | |
|---|---|---|
| EP | 0 520 578 A2 | 12/1991 |
| GB | 2 299 114 A | 9/1996 |

OTHER PUBLICATIONS

International Search Authority, "PCT Notification of Transmittal of the International Search Report or the Declaration," PCT/GB 00/03834, Dated Dec. 13, 2000, 7 pages.

* cited by examiner

*Primary Examiner*—Hoang Dang
(74) *Attorney, Agent, or Firm*—Moser, Patterson & Sherdian, L.L.P.

(57) ABSTRACT

The present invention generally provides a system and method for stiffening a cutting tool assembly used in cutting laterally relative to a wellbore axis to reduce stresses and cyclical bending of the cutting tool assembly during cutting. The system includes a cutting tool attached to a shaft such as an output shaft of a motor or a drill string. A sleeve is disposed in an annular space, known as a box relief, defined between the shaft and a peripheral wall of the cutting tool. The sleeve is preferably fixed in the annular space by a sleeve ring surrounding a recess in the shaft, but can be coupled to the peripheral wall and/or shaft by, for example, a threaded engagement. As the cutting tool attempts to bend at a connection with the shaft during cutting, creating stresses at the connection, the stresses are distributed throughout the increased contact area of the sleeve with the cutting tool, causing less stress per unit area and distributing at least a portion of the stress away from the threaded engagement between the shaft and the cutting tool. The reduced stresses cause less fatigue and thus lower failure rate of the members. Also, the walls of the cutting tool surrounding the shaft are lengthened to engage even more surface area of the sleeve and further reduce the bending stresses. Also, the distance between the cutting portion of the cutting tool and an engagement portion between the cutting tool and the shaft can be shortened to reduce stresses on the engagement portion by forming a shorter cutting tool.

19 Claims, 3 Drawing Sheets

METHOD AND APPARATUS FOR STIFFENING AN OUTPUT SHAFT ON A CUTTING TOOL ASSEMBLY

BACKGROUND OF THE INVENTION

1. Field of the Invention

The present invention relates to oil field tools. More specifically, the invention relates to a system for and a method of using cutting tools disposed in wellbores.

2. Background of the Related Art

Historically, oil field wells are drilled as a vertical shaft to a subterranean producing zone forming a wellbore, the wellbore is lined with a steel tubular casing, and the casing is perforated to allow production fluid to flow into the casing and up to the surface of the well. In recent years, oil field technology has increasingly used sidetracking or directional drilling to further exploit the resources of productive regions. In sidetracking, a slot or "window" is cut in a steel cased wellbore typically using a mill and drilling is continued at angles to the vertical wellbore. In directional drilling, a wellbore is cut in strata at an angle to the vertical shaft typically using a drill bit. The mill and the drill bit are rotary cutting tools having cutting blades or surfaces typically disposed about the tool periphery and in some models on the tool end.

FIG. 1 is a schematic cross sectional view of a typical vertical wellbore 10. A casing 12 is disposed in the wellbore with a cutting tool 14, such as a mill, having cut a portion of a window 16 in a sidewall of the casing. The cutting tool 14 can be coupled to tubing 32, such as coiled tubing or a drill string, by a motor 19 having a shaft 18 that rotates the cutting tool. In such instance, the shaft 18 is known as an output shaft. Alternatively, the cutting tool can be coupled to a shaft 18 that forms a portion of a drill string that is attached to a surface rig. A motor disposed on the surface rig rotates the drill string which rotates the cutting tool and cuts the casing or other downhole components.

To direct the cutting tool 14 toward the side of the casing 12, a whipstock 22 is inserted into the wellbore. The whipstock 22 is used to direct the cutting tool or other tool in a direction that is angularly offset to the original wellbore by using a whipstock face 24, that is, a sloped surface which progressively narrows the open cross sectional area in the casing 12. The whipstock 22 is set in position in the casing at a given depth and the cutting tool 14 engages the whipstock face 24 as the cutting tool traverses downward. The cutting tool 14 is progressively deflected laterally toward the casing 12 as the cutting tool cuts the window 16. After the window 16 is cut and the cutting tool is removed, the whipstock 22 can remain in position to guide subsequent operations, such as directional drilling with drill bits.

FIG. 2 is a schematic cross sectional view of a cutting tool 14 coupled to the motor 19 at joint 26. The motor 19 includes an output end 46 and a shaft 18, where the motor transmits torque to the cutting tool 14 through the shaft 18. The cutting tool 14 is coupled to an end 34 of the shaft 18 at an engagement section 36 internally disposed in a bore 39 of the cutting tool 14. The shaft 18 has threads 35 which engage corresponding threads 37 on the cutting tool 14. A portion of the end 34 of the shaft 18 is surrounded by a peripheral wall 40 of the cutting tool disposed upstream from the engagement section 36 and defines an annular space 42, known as a box relief. The shaft 18 has a hexagonal shaft portion 52, which provides engagement surfaces for a wrench (not shown). By convention, an end 44 of the peripheral wall 40 is typically aligned with the downstream end 53 of the shaft portion 52, leaving exposed a portion of the shaft 18. A passageway 48 is formed in the shaft 18 and the cutting tool 14, where the passageway allows fluid to flow through the shaft and the cutting tool and then to exit through nozzles 50 in the cutting tool for washing away the debris as the cutting tool is rotated.

FIG. 3 is a schematic cross sectional view through the shaft, showing the peripheral wall 40 of the cutting tool surrounding the shaft 18 and the shaft portion 52. The peripheral wall 40 disposed about the perimeter of the shaft 18 defines the annular space 42.

One challenge with cutting a window with a mill or drilling an angled wellbore with a drill bit is the stress imparted to the cutting tool 14 and the shaft 18. The stress imparted from cutting the side of the casing 12 for a mill or the strata for a drill bit is not evenly displaced about a circumference of the rotating components. For instance, as best seen in FIG. 1, at joint 26 defining the connection between the shaft and the cutting tool, a first portion 28 of the joint 26 on the side of the cutting tool that cuts the window is placed under a longitudinal compressive load, but the portion 30 of the joint 26 that is opposite the window 16 is placed under a longitudinal tensile load. As the joint rotates, each portion 28, 30 is subjected to alternating compressive and tensile stresses. Additionally, the stresses on the joint 26 are proportional to the distance between the cutting surfaces of the cutting tool and the joint. A longer distance proportionally increases the stresses. The alternating stresses, especially using long cutting tools, create cyclical bending of the members, such as the cutting tool 14 and the shaft 18, and can produce stress fatigue and failure of one or more of the members. It is believed that at least a portion of the failures are due to stress concentrations in a stress failure region 41 near an upstream end of the threads 35 on the shaft 18. The downtime can be costly for retrieving a broken shaft 18 that involves fishing the parted assembly from the wellbore, replacing the shaft and reinserting the assembly down the wellbore.

There remains a need for an improved system and method for using a cutting tool at an angle in a wellbore, particularly for stiffening a cutting tool system to avoid the cyclical bending.

SUMMARY OF THE INVENTION

The present invention generally provides a system and method for stiffening a cutting tool assembly used in cutting laterally relative to a wellbore axis to reduce stresses and cyclical bending of the cutting tool assembly during cutting. The system includes a cutting tool attached to a shaft such as an output shaft of a motor or a drill string. A sleeve is disposed in an annular space, known as a box relief, defined between the shaft and a peripheral wall of the cutting tool. The sleeve is preferably fixed in the annular space by a sleeve ring surrounding a recess in the shaft, but can be coupled to the peripheral wall and/or shaft by, for example, a threaded engagement. As the cutting tool attempts to bend at a connection with the shaft during cutting, creating stresses at the connection, the stresses are distributed throughout the increased contact area of the sleeve with the cutting tool, causing less stress per unit area and distributing at least a portion of the stress away from the threaded engagement between the shaft and the cutting tool. The reduced stresses cause less fatigue and thus lower failure rate of the members. Also, the walls of the cutting tool surrounding the shaft are lengthened to engage even more surface area of the sleeve and further reduce the bending stresses. Also, the distance between the cutting portion of the cutting tool and an engagement portion between the cutting tool and the shaft can be shortened to reduce stresses on the engagement portion by forming a shorter cutting tool.

In one aspect, the invention provides a window milling system, comprising a shaft, a mill coupled to the shaft having walls at least partially surrounding a portion of the shaft. defining an annular space between the walls and the shaft, and a sleeve disposed in the annular space. The sleeve is preferably a split sleeve that fits snugly in the annular space. In another aspect, the invention provides a method of cutting a casing with a window mill system, comprising engaging a shaft with a mill, coupling the shaft to a rotatable member, placing the mill downhole in a wellbore, cutting a portion of a casing disposed in the wellbore with the mill, causing bending stresses on the mill, and at least partially distributing the bending stresses onto a sleeve disposed in an annular space between the mill and the shaft. A whipstock can be used to direct the mill laterally into the casing. In another aspect, the invention provides a cutting tool system, comprising a shaft, a cutting tool coupled to the shaft having at least one peripheral wall at least partially surrounding a portion of the shaft and defining an annular space between the wall and the shaft, and a sleeve disposed in the annular space. In another aspect, the invention provides a method of using a cutting tool, comprising engaging a shaft with a cutting tool, coupling the shaft to a rotatable member, placing the cutting tool downhole in a wellbore, causing bending stresses on the cutting tool, and at least partially distributing the bending stresses onto a sleeve disposed in an annular space between the cutting tool and the shaft.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

The present invention provides an improvement to a cutting tool system used downhole in wellbores to stiffen the cutting tool system and reduce bending stresses per square unit of area thereon. The system can also be used to retrofit existing units. The cutting tool system includes a cutting tool attached to a motor having an output shaft and a sleeve disposed in an annular space, known as a box relief, defined between the shaft and a peripheral wall of the cutting tool. The sleeve can be coupled to the peripheral wall and/or shaft. Bending stresses are distributed throughout the increased contact area of the sleeve with the cutting tool and the shaft. Also, the walls of the cutting tool surrounding the shaft can be lengthened to engage even more surface area of the sleeve and further reduce the bending stresses.

Figure 2:
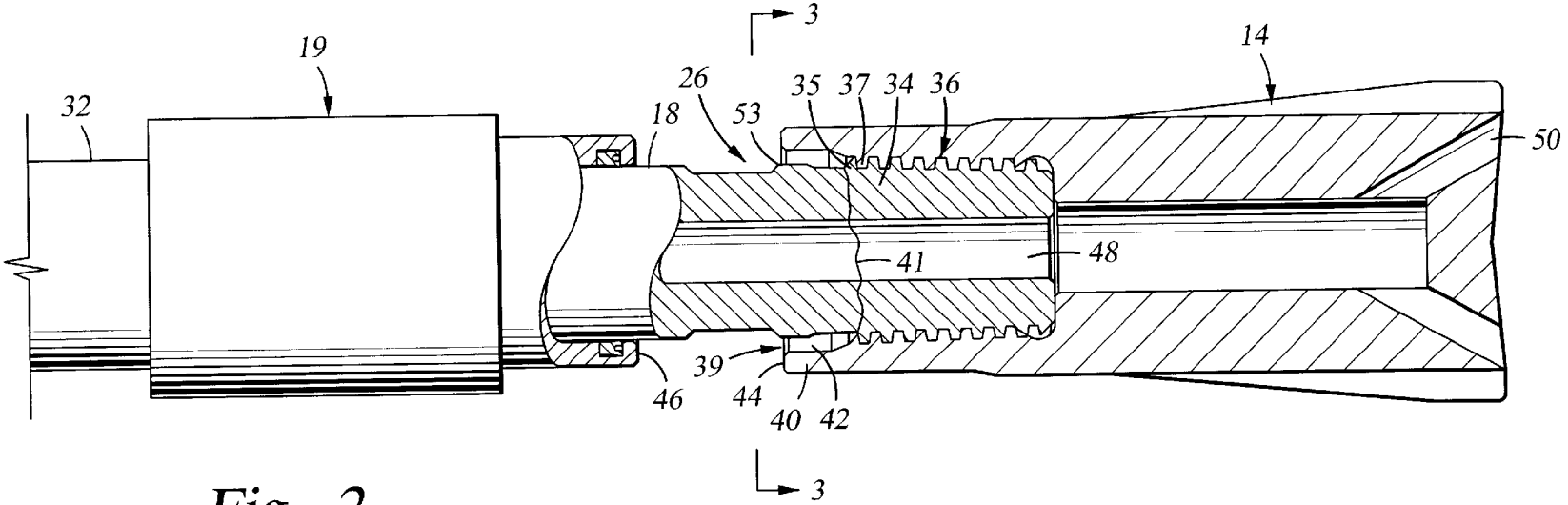
Fig. 2 (PRIOR ART)
FIG. 2 is a schematic cross sectional view of a typical cutting tool coupled to a motor with an output shaft.
Figure 3:
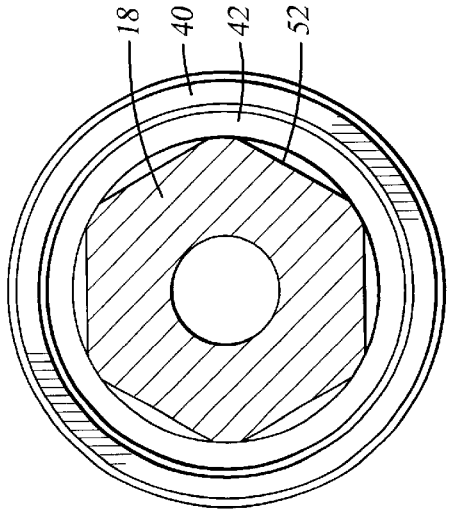
Fig. 3 (PRIOR ART)
FIG. 3 is a schematic end view of a peripheral wall of the cutting tool surrounding the shaft, shown in FIG. 2.
Figure 4:
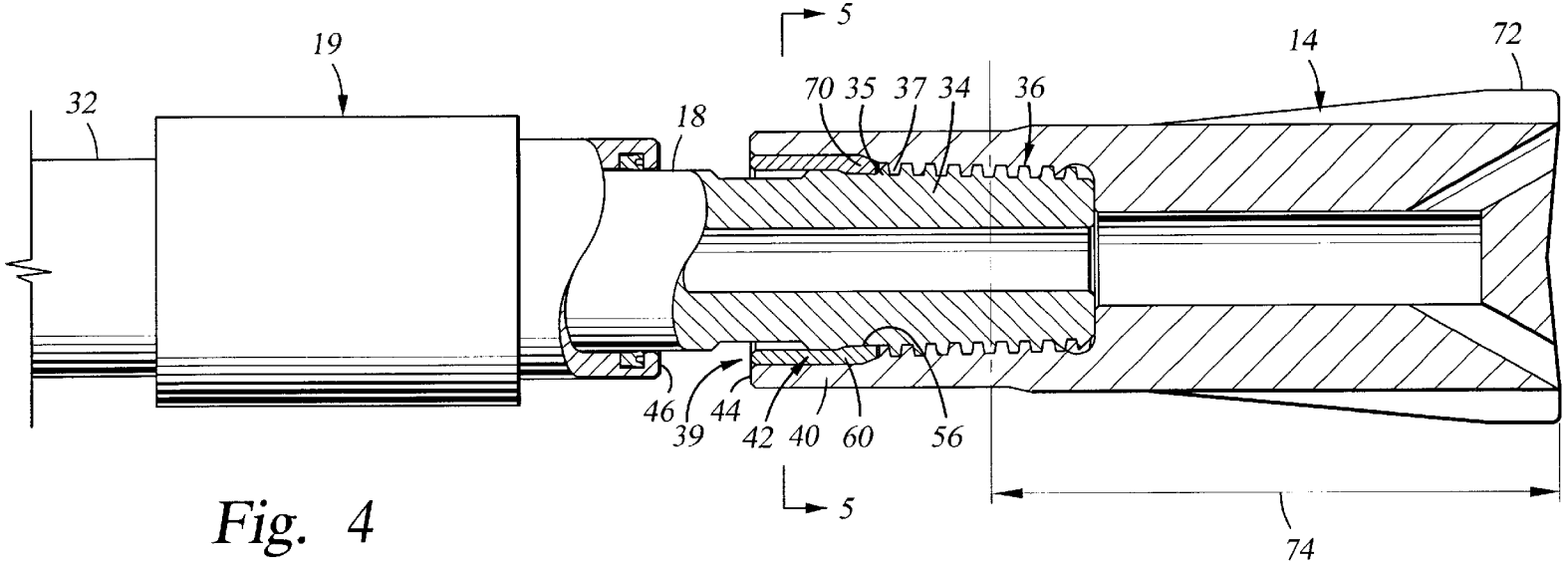
FIG. 4 is a schematic cross sectional view of one embodiment of the invention.

FIG. 4 is a schematic cross sectional view of a portion of the cutting tool system of the present invention, such as a window milling system using a mill or a drilling system using a drill bit. The elements are similarly numbered as in FIGS. 2 and 3 where appropriate. A tubing 32 is coupled to a motor 19 having a output end 46 and a shaft 18 to transmit torque to a cutting tool 14. The cutting tool 14 is coupled to an end 34 of the shaft 18 at an engagement section 36, where the shaft 18 has threads 35 which engage corresponding threads 37 on the cutting tool 14. A peripheral wall 40 of the cutting tool disposed upstream from the engagement section 36 surrounds a portion of the end 34 of the shaft 18, defining an annular space 42 therebetween, referred to as a box relief.

A sleeve 60 is disposed in the annular space 42. Preferably, the sleeve 60 substantially fills the annular space between the diameter of the peripheral wall 40 and the projected diameter of the shaft portion 52, shown in FIG. 5, where the corners of the hexagonal faces define a projected diameter 54 of a circle circumscribing the shaft portion. The sleeve 60 preferably fits tightly into the annular space 42 to minimize lateral movement between the peripheral wall 40 and the shaft 18. A sleeve ring 70 can be formed in the sleeve 60 as an integral portion of the sleeve. The sleeve ring 70 is preferably smaller in diameter than an upstream portion of the shaft 18, such as the projected diameter 54 of the shaft portion 52. The sleeve ring 70 provides a surface that abuts the shaft 18 at a smaller diameter region 56, such as a thread relief, of the shaft 18 to restrain the sleeve longitudinally within the annular space 42 after the shaft is assembled with the cutting tool 14. Alternatively, the sleeve ring 70 could be formed on the external surface of the sleeve 60 to engage the peripheral wall 40 to be restrained with the peripheral wall upon assembly of the shaft 18 with the cutting tool 14. The sleeve 60 can also be press fitted into position and preferably would be press fitted on the inside diameter of the peripheral wall 40 to leave some clearance for the shaft 18 to rotate in the sleeve 60. The sleeve can be made of a variety of materials commensurate with the conditions of the wellbore and the stresses placed on the sleeve. As an example, the sleeve can be made of alloy or stainless steel or other various materials sufficient to withstand the typical downhole conditions and stresses. The material is preferably material that allows the shaft 18 to turn within the sleeve without significant wear of the shaft 18.

The sleeve 60 provides an increased amount of surface area on which bending stresses are distributed, such as the stresses created from a lateral force on the cutting tool as the cutting tool cuts a window in a casing. The internal surfaces of the peripheral wall that otherwise would bend toward the shaft 18 are believed to be restrained by the presence of the sleeve and the associated surface area thereof. The sleeve allows at least a portion of the stresses to be distributed away from the engagement portion 36 and into a region of the shaft adjacent the sleeve. It is believed that with more surface area to distribute stresses, less stress on the connections between the members and particularly at the engagement section 36 will occur and the failure of one or more of the members due to material fatigue in the region of the engagement section will decrease.

The end 44 of the peripheral wall 40 can also be extended to within about ⅛ inch of the output end 46 of the motor 19, that is, the surface of the motor surrounding the output shaft that is nearest the cutting tool which would otherwise hit the cutting tool without any clearance. The extension of the peripheral wall 40 can further increase the surface area of the peripheral wall 40 engaging the sleeve 60. The ⅛ inch represents a practical consideration of a clearance for the ends if the members bend and provides a clearance for flexing of the cutting tool 14 assembled to the shaft 18. As an example, the amount of clearance can preferably vary from about 0 inches to about ½ inch. The sleeve 60 can also be lengthened a corresponding distance so that the end of the sleeve is aligned with the end 44 of the peripheral wall 40 to maximize the contact between the sleeve and peripheral wall.

To further reduce the bending stresses between the cutting tool 14 and the shaft 18, the length of the cutting tool 14 can be shortened. A shorter cutting tool provides a shorter distance 74 between a cutting surface 72 of the cutting tool and the engagement portion 36. Because the stress imparted to the engagement portion 36 is proportional to the distance from the cutting surface 72 of the cutting tool 14 to the engagement portion, a shorter distance results in less stress.

Figure 5:
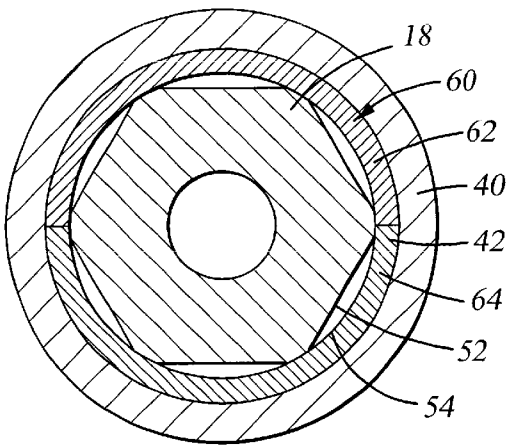
FIG. 5 is a schematic end view of a peripheral wall of the cutting tool surrounding the shaft, shown in FIG. 4.

FIG. 5 is a cross sectional view through the shaft 18, showing peripheral wall 40 and sleeve 60. The sleeve is disposed between the peripheral wall 40 and the projected diameter 54 of the shaft portion 52 of the shaft 18. Alternatively, if a round portion of the shaft 18 engages the sleeve, then the sleeve can fit around the diameter of the round portion in a corresponding manner. The shaft portion 52 rotates within the sleeve 60 in operation of the cutting tool.

Figure 6:
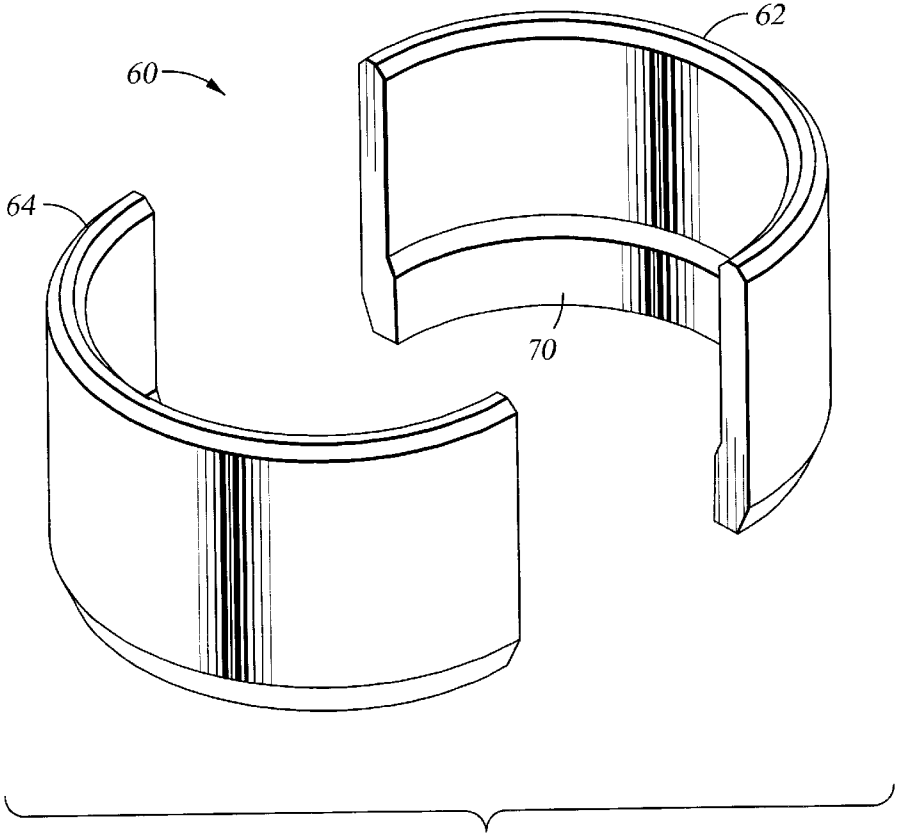
FIG. 6 is a perspective schematic view of the sleeve.

FIG. 6 is a perspective schematic view of the sleeve 60. The sleeve is preferably a split sleeve, that is, has at least one or more sleeve portions. Preferably, the sleeve 60 has a first sleeve portion 62 and a second sleeve portion 64, forming two halves for ease of assembly. Each sleeve portion preferably has a sleeve ring 70 near the base of the sleeve portions that engage the shaft 18 at the smaller diameter region 56, shown in FIG. 4, to restrain the sleeve from longitudinal movement when assembled.

Figure 1:
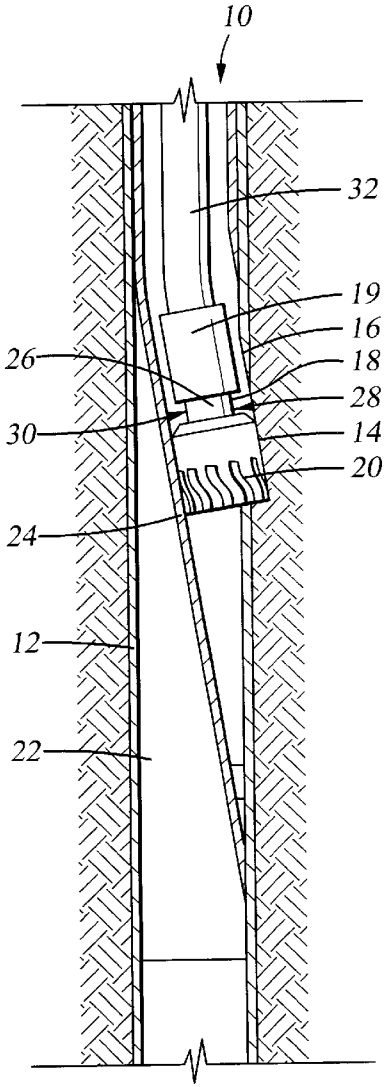
Fig. 1 (PRIOR ART)
FIG. 1 is a schematic cross sectional view of a typical vertical wellbore with a cutting tool, such as a mill, having cut a portion of a window in a casing disposed in the wellbore.

In operation, a motor 19 is attached to a tubing 32, a sleeve 60 is positioned around a shaft 18 and a cutting tool 14 is attached to the assembly, shown in FIG. 4. The shaft 18 is engaged with and tightened into the cutting tool 14 with the sleeve 60 disposed between a peripheral wall 40 and the shaft 18. The sleeve 60 is restrained longitudinally by the sleeve ring 70 disposed about the shaft 18 or by a threaded engagement or other restraining elements. The assembly is inserted downhole. Alternatively, the cutting tool 14 can be assembled to another portion of a drill string (not shown) if the cutting tool is to be rotated from the surface of the well with the drill string. As shown in FIG. 1, the cutting tool 14 contacts a pre-positioned whipstock 22 disposed downhole in the wellbore and progressively engages the surface of a casing to cut a window or other aperture in the casing. Alternatively, the cutting tool 14 can be used to cut strata at an angle, such as with a drill bit, for directional drilling. The cutting action results in a lateral load on the cutting tool 14 and attempts to bend the peripheral wall 40 of the cutting tool toward the shaft 18 on the cutting side and away from the shaft opposite from the cutting side. It is believed that the bending is reduced by the presence of the sleeve 70 disposed between the peripheral wall 40 and the shaft 18, resulting in less stress per unit area of contact and less stress on the members.

While the foregoing is directed to the preferred embodiment of the present invention, other and further embodiments of the invention may be devised without departing from the basic scope thereof, and the scope therefore is determined by the claims that follow.

What is claimed is:

1. A method of cutting a casing with a window mill system, comprising:

a) engaging a shaft with a mill;

b) coupling the shaft to a rotatable member;

c) placing the mill downhole in a wellbore;

d) cutting a portion of a casing disposed in the wellbore with the mill;

e) causing bending stresses on the mill; and f) at least partially distributing the bending stresses onto a sleeve disposed in an annular space between the mill and the shaft.

2. The method of claim 1, wherein cutting the portion of the casing comprises rotating the mill with a motor coupled to the shaft.

3. The method of claim 1, wherein the shaft comprises an output shaft.

4. The method of claim 1, further comprising disposing a whipstock downhole in the wellbore and wherein cutting a portion of the casing comprises engaging the whipstock with the mill.

5. The method of claim 1, further comprising placing a split sleeve in the annular space between the mill and the shaft.

6. A cutting tool system, comprising:

a) a shaft;

b) a cutting tool coupled to the shaft having at least one peripheral wall at least partially surrounding a portion of the shaft and defining an annular space between the wall and the shaft; and c) a sleeve disposed in the annular space, the sleeve press fitted into the annular space between the tool and the shaft.

7. A window milling system, comprising:

a) a shaft;

b) a mill coupled to the shaft having at least one peripheral wall at least partially surrounding a portion of the shaft and defining an annular space between the wall and the shaft; and c) a sleeve disposed in the annular space, the sleeve press fitted into the annular space between the mill and the shaft.

8. A window milling system, comprising:

a) a shaft;

b) a mill coupled to the shaft having at least one peripheral wall at least partially surrounding a portion of the shaft and defining an annular space between the wall and the shaft; and c) a sleeve pressed fitted into the annular space, the sleeve restricting pivotal movement of the shaft with respect to the mill.

9. The window milling system of claim 8, wherein the sleeve is a split sleeve.

10. The window milling system of claim 8, wherein the wall extends in close proximity to an adjacent end of a motor.

11. The window milling system of claim 10, wherein the wall extends to within about ⅛" of the adjacent motor end.

12. The window milling system of claim 8, wherein the sleeve comprises steel.

13. The window milling system of claim 8, wherein internal surfaces of sleeve conform to the shape of the shaft.

14. A cutting tool system, comprising:

a) a shaft;

b) a cutting tool coupled to the shaft having at least one peripheral wall at least partially surrounding a portion of the shaft and defining an annular space between the wall and the shaft; and c) a sleeve pressed fitted into the annular space to distribute bending stresses between the cutting tool and the shaft.

15. The cutting tool system of claim 14, wherein the sleeve is a split sleeve.

16. The cutting tool system of claim 14, wherein the wall extends in close proximity to an adjacent end of a motor.

17. The cutting tool system of claim 14, wherein the wall extends to within about ⅛" of the adjacent motor end.

18. The cutting tool system of claim 14, wherein the sleeve comprises steel.

19. The cutting tool system of claim 14, wherein internal surfaces of sleeve conform to the shape of the shaft.

* * * * *

UNITED STATES PATENT AND TRADEMARK OFFICE

CERTIFICATE OF CORRECTION

PATENT NO. : 6,374,916 B1
DATED : April 23, 2002
INVENTOR(S) : Laflin

It is certified that error appears in the above-identified patent and that said Letters Patent is hereby corrected as shown below:

Column 6,
Line 56, please change “pressed” to -- press --.

Column 7,
Line 9, please change “pressed” to -- press --.

Column 8,
Line 5, please change “of claim 14” to -- of claim 16 --.

Signed and Sealed this

Second Day of September, 2003

JAMES E. ROGAN
*Director of the United States Patent and Trademark Office*